US005818417A

United States Patent [19]

Mattison

[11] Patent Number: 5,818,417

[45] Date of Patent: Oct. 6, 1998

[54] AUTOMATIC VIRTUAL DISPLAY PANNING CIRCUIT FOR PROVIDING VGA DISPLAY DATA TO A LOWER RESOLUTION DISPLAY AND METHOD THEREFOR

[75] Inventor: Phillip Eugene Mattison, Gilbert, Ariz.

[73] Assignee: VLSI Technology, Inc., San Jose, Calif.

[21] Appl. No.: 902,186

[22] Filed: Jun. 22, 1992

[51] Int. Cl.[6] ..... G09G 5/00

[52] U.S. Cl. ..... 345/132; 345/501; 345/515; 345/507

[58] Field of Search ..... 340/724, 726, 340/731, 814, 799, 793; 345/121, 123, 127, 132, 185, 189, 196, 501, 507, 515, 509, 516, 511, 213

[56] References Cited

U.S. PATENT DOCUMENTS

| | | | |
|---|---|---|---|
| 4,439,762 | 3/1984 | Van Vliet et al. | 340/799 |
| 4,618,858 | 10/1986 | Belch | 340/724 |
| 4,924,522 | 5/1990 | Bray et al. | 340/793 |
| 4,940,970 | 7/1990 | Fujisaku | 340/724 |
| 5,006,837 | 4/1991 | Bowers | 340/724 |
| 5,150,109 | 9/1992 | Berry | 340/811 |

FOREIGN PATENT DOCUMENTS

| | | | |
|---|---|---|---|
| 0034894 | 2/1990 | Japan | 340/724 |

*Primary Examiner*—Lun-Yi Lao

*Attorney, Agent, or Firm*—Harry M. Weiss; Jeffrey D. Moy; Harry M. Weiss & Associates, P.C.

[57] ABSTRACT

A circuit and method for providing VGA display data to a display of lower resolution, such as an LCD panel, is disclosed. The circuit detects a write to the Frame Buffer that stores the full resolution VGA image, determines the address within the Frame Buffer that was changed, then translates the Start Address of the circuit such that the recently updated data will be displayed at or near the center row of the display. The circuit blocks accesses to display data outside the range of data displayed on the lower resolution display such that the operation of the circuit is transparent to a conventional VGA controller, thereby providing automatic virtual display panning for VGA data that is displayed on a lower resolution display such as an LCD panel.

4 Claims, 2 Drawing Sheets

AUTOMATIC VIRTUAL DISPLAY PANNING CIRCUIT FOR PROVIDING VGA DISPLAY DATA TO A LOWER RESOLUTION DISPLAY AND METHOD THEREFOR

FIELD OF THE INVENTION

This invention generally relates to computer display devices and methods, and more specifically relates to a circuit and method for driving Virtual Graphics Adapter (VGA) display data in 640×480 pixel format to a smaller display with less resolution, such as a Liquid Crystal Display (LCD).

DESCRIPTION OF THE PRIOR ART

The conventional display resolution for a VGA display is 640×480 pixels. Some small portable computers typically have an LCD panel with less than the 640×480 VGA resolution. If software is written to take advantage of the full VGA display resolution, this software cannot typically be run on these LCD panels with reduced resolution, since the display formats are incompatible.

Therefore, there existed a need to provide a circuit which can translate standard VGA display data stored in a conventional 640×480 format to a format compatible with a display of less resolution such as an LCD panel.

SUMMARY OF THE INVENTION

It is an object of this invention to provide an automatic virtual display panning circuit and method for translating a portion of standard 640×480 VGA display data to a format usable by a display device of less resolution, such as an LCD panel.

The preferred embodiment of the circuit of the present invention provides address translation to drive a portion of the virtual VGA display image stored in a frame buffer on a display device of less resolution, such as an LCD panel. A typical Frame Buffer for storing VGA display data is divided into a series of contiguous blocks of memory of equal size. Each block contains the display data for a single row of the VGA display. In this manner a VGA controller can access the data sequentially in the frame buffer and output this display data to the VGA display device, row by row. If a display device such as an LCD panel has less than the standard 640×480 resolution, the VGA controller must determine which portions of the frame buffer need to be outputed to the display device. The circuit of the present invention automatically detects a write to the Frame Buffer containing the virtual VGA display image, and creates a new start address that places the new data at the approximate vertical center of the LCD panel. In addition, this circuit blocks reads to portions of the Frame Buffer outside of the limits defined by the LCD panel.

If the LCD panel has half the vertical and half the horizontal resolution of the standard 640×480 VGA display device, it will have a resolution of 320×240 pixels, and can therefore display one-fourth of the virtual VGA display at any given time. The circuit of the present invention detects a write to the Frame Buffer, and translates the starting address of the VGA controller such that the data just written to the Frame Buffer will be at or near the center row of the LCD panel. The VGA Controller then accesses the portion of display data needed to drive the physical LCD panel. In this manner only one-fourth of the display data in the frame buffer is accessed and provided to the LCD panel, which displays only a portion of the virtual VGA image stored in the frame buffer.

The foregoing and other objects, features and advantages will be apparent from the following description of the preferred embodiment of the invention as illustrated in the accompanying drawings.

DESCRIPTION OF THE PREFERRED EMBODIMENTS

Figure 1:
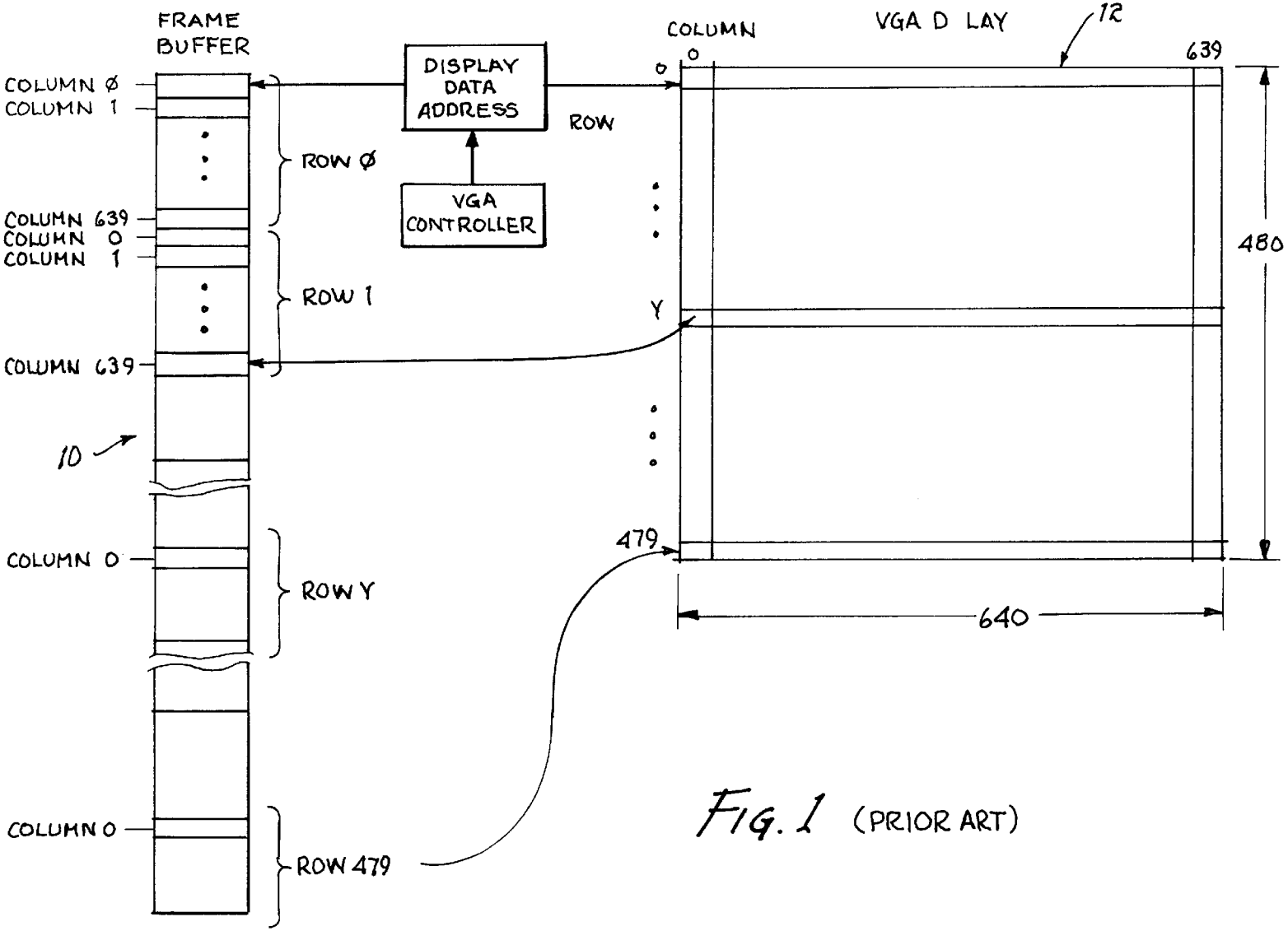
FIG. 1 (PRIOR ART)
FIG. 1 is a block diagram of the VGA Controller of the prior art driving a conventional VGA display device.

The present invention can be best understood by first referring to the VGA display system of the prior art shown in FIG. 1. The Frame Buffer 10 is a block of memory wherein the complete 640×480 Virtual VGA Display image is stored. As shown in FIG. 1, Frame Buffer 10 is divided into blocks that constitute the rows of the display, as shown by Row 0, Row 1, Row Y, and Row 479. Each row is further divided into columns, as shown by Column 0, Column 1, and Column 639 in Row 0 and Row 1. Each location in the Frame Buffer 10 therefore corresponds to a unique row-column location on the physical VGA Display Device 12. The VGA controller simply takes the starting address of Frame Buffer 10, and outputs the display data sequentially to the VGA Display Device 12 until all data in the Frame Buffer 10 has been output. When new display data is stored in the Frame Buffer 10, this new data is output to the VGA Display Device 12 on the next pass when the VGA Controller outputs display data from the Frame Buffer 10 to the VGA Display Device.

Figure 2:
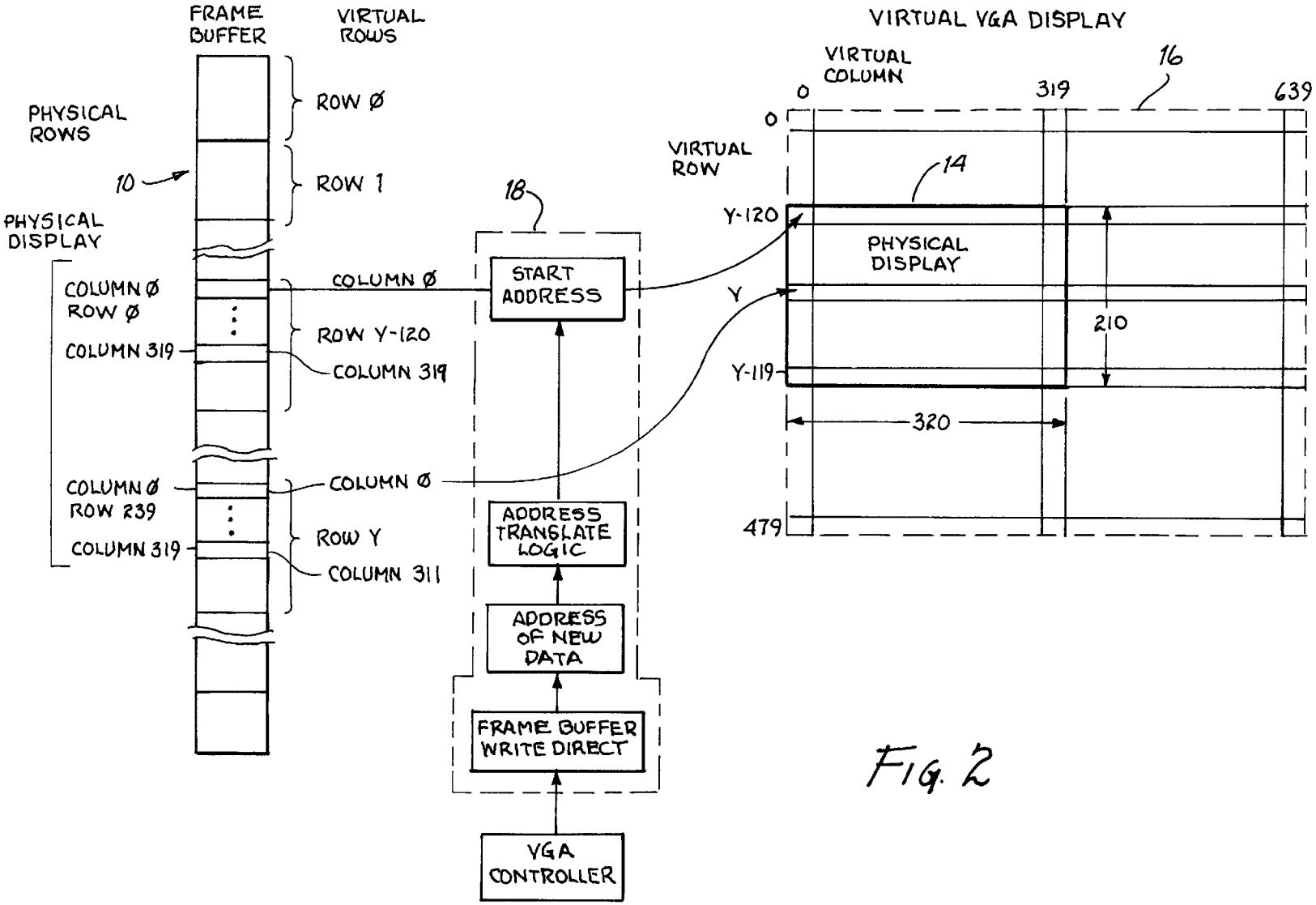
FIG. 2 is a block diagram of a VGA Controller incorporating the circuitry of the present invention allowing a portion of the 640×480 VGA display data stored in the frame buffer to be displayed on the lower resolution LCD panel according to which portion of the frame buffer was updated most recently.

If the display device has less resolution than the standard 640×480 VGA display resolution, a means and method of displaying only the appropriate and most recent display data in the Frame Buffer 10 must be devised, and is the subject of the present invention. The preferred embodiment of the present invention is shown in FIG. 2, which shows a Physical Display 14 that has a resolution less than the resolution of the 640×480 Virtual VGA Display 16. For illustrative purposes, the physical display is assumed to have a resolution of 320×240 pixels, which is half of the standard VGA resolution, allowing one-fourth of Virtual VGA Display 16 to be displayed at any given time on the Physical Display 14. The circuit 18 of the present invention is shown in FIG. 2. The circuit 18 detects a write to the Frame Buffer 10, shown here for an example as Column 0, Row Y, determines the address of that write, and translates the Start Address to Y−120 such that the new data written to the Frame Buffer 10 will appear at or near the center row of the Physical Display 14.

OPERATION

As a specific example, suppose data in Row Y is updated in the Frame Buffer. The circuit 18 will detect this write, determine the address of the write, and configure a new Start Address Y−120 for updating the display such that Row Y will be near the center of the display. If the new data in Row Y lies within the range of column 0 to column 319 of the Virtual VGA Display 16, these columns will be displayed in the Physical Display 14, as shown in the Frame Buffer 10 of FIG. 2, where only columns 0 through 319 are displayed.

With this arrangement, only the first half of each displayed row is outputed before continuing with the next row. Since the data in Columns 320–639 is outside of the "window" defined by the Physical Display 14, this data is not outputed to the Physical Display 14. If the new data in Row Y lies within the range of column 320 to column 639 of the Virtual VGA Display 16, these columns will be displayed in the Physical Display 14. With this arrangement, only the last half of each displayed row is outputed before continuing with the next row. The circuit 18 of the present invention changes the Start Address to select the appropriate rows to display as well as the appropriate half of the rows.

In the specific example shown in FIG. 2, Columns 0–319 of Rows Y−120 to Y+119 will be output in sequence, with the accesses to data outside this range blocked by the Address Translate Logic of circuit 18. In this manner, the operation of the VGA Controller is completely transparent to the size of the Physical Display 14, since the VGA Controller continues to access data sequentially as if a full-resolution VGA display device were present, with the address translation for a display device of less resolution provided automatically by the circuit 18.

While the invention has been described in its preferred embodiment, it is to be understood that the words which have been used are words of description rather than limitation, and that changes may be made within the purview of the appended claims without departing from the true scope and spirit of the invention in its broader aspects. For example, the actual size of the Physical Display 14 can vary, with the circuit 18 being configured to accommodate the size of the particular Physical Display 14. In addition, the Start Address may define any column range of the displayed rows to accommodate different applications rather than the two column ranges specifically disclosed herein.

I claim:

1. A circuit for providing automatic virtual display panning for driving VGA display data on a lower resolution display comprising, in combination:

frame buffer memory means for storing a full resolution VGA image;

display means coupled to said frame buffer memory means and having a resolution less than the resolution of said frame buffer memory means for providing a display;

VGA controller means for transferring display data in said frame buffer memory means to said display means;

frame buffer write detect means for detecting a write of a new value of display data into said frame buffer memory means;

address detect means coupled to said frame buffer write detect means for determining an affected address where said new value of display data is stored within said frame buffer memory means in response to said frame buffer write detect means;

address translate logic means for generating an appropriate start address for updating said display means based on said affected address within said frame buffer memory means where said new value of display data was stored; and blocking means for selectively blocking memory accesses to said frame buffer memory means which fall outside the range of applicable display data for said display means.

2. The circuit of claim 1 wherein said start address within said frame buffer memory means is generated such that said new value of display data is near a substantial vertical center of said display means.

3. A method for providing automatic virtual display panning for driving VGA display data on a lower resolution display consisting of the steps of:

providing frame buffer memory means for storing a full resolution VGA image;

providing display means coupled to said frame buffer memory means and having a resolution less than the resolution of said frame buffer memory means for providing a display;

providing VGA controller means for transferring display data in said frame buffer memory means to said display means;

providing frame buffer write detect means for detecting a write of a new value of display data into said frame buffer memory means;

providing address detect means coupled to said frame buffer write detect means for determining an affected address where said new value of display data is stored within said frame buffer memory means in response to said frame buffer write detect means;

providing address translate logic means for generating an appropriate start address for updating said display means based on said affected address within said frame buffer memory means where said new value of display data was stored; and providing blocking means for selectively blocking memory accesses to said frame buffer memory means which fall outside the range of applicable display data for said display means.

4. The method of claim 3 wherein said start address within said frame buffer memory means is generated such that said new value of display data is near a substantial vertical center of said display means.

* * * * *